US005473841A

United States Patent [19]

Grillo

[11] Patent Number: 5,473,841

[45] Date of Patent: Dec. 12, 1995

[54] DEVICE FOR LIMITING OPENING MOVEMENT OF A DOOR

[76] Inventor: Michael A. Grillo, Condominium Tiffany #303, Carolina, Puerto Rico, 00979

[21] Appl. No.: 365,595

[22] Filed: Dec. 28, 1994

[51] Int. Cl.[6] ..... E05B 65/06

[52] U.S. Cl. ..... 49/394; 292/338

[58] Field of Search ..... 49/394; 292/338, 292/262, 263

[56] References Cited

U.S. PATENT DOCUMENTS

| | | | |
|---|---|---|---|
| 1,002,812 | 9/1911 | Moore | 292/338 |
| 1,054,151 | 2/1913 | Troetel | 292/338 |
| 1,693,860 | 12/1928 | Olson | 292/338 X |
| 2,760,806 | 8/1956 | Woodard et al. | 292/338 |
| 3,206,793 | 9/1965 | Silverberg | 292/288 X |
| 4,070,049 | 1/1978 | Brewer | 292/263 |
| 4,070,049 | 1/1978 | Brewer . | |
| 4,346,926 | 8/1982 | Lucas | 292/338 |
| 4,671,014 | 6/1987 | Lack | 49/394 |
| 4,858,972 | 8/1989 | Salyer | 292/338 |
| 5,039,147 | 8/1991 | Moon et al. | 292/338 |
| 5,127,688 | 7/1992 | Eldh | 292/338 |

*Primary Examiner*—Philip C. Kannan

*Attorney, Agent, or Firm*—Vaden, Eickenroht, Thompson & Feather

[57] ABSTRACT

There is disclosed a device for limiting the swinging of a door hingedly connected to a second wall adjacent to the first wall. The device includes a bracket adapted to be mounted on the door hinge for swinging about its axis, as well as first and second arms pivotally connected to the bracket for swinging toward and away from the door and adjacent wall, respectively. A strut extends between the arms to limit swinging the first arm toward the second arm when the second arm is against the second wall, and one end of the strut is movable away from a stop on the second arm to permit the door to be opened and/or the arms to be stored next to one another.

7 Claims, 6 Drawing Sheets

FIG. 8
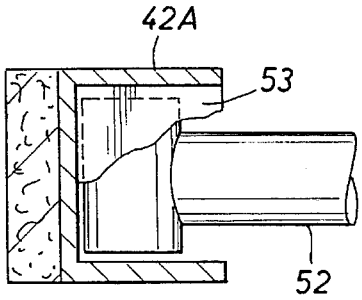
FIG. 9
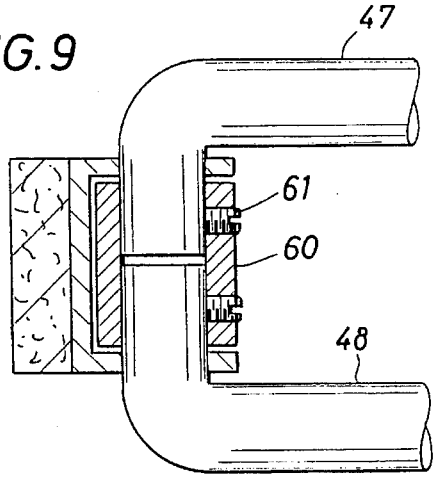
FIG. 10
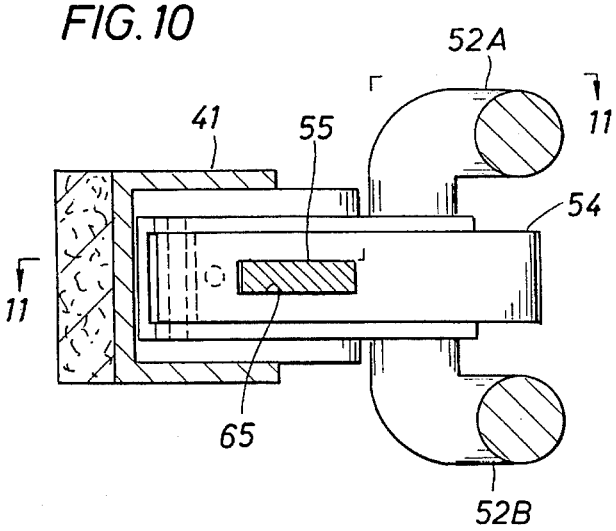
FIG. 11
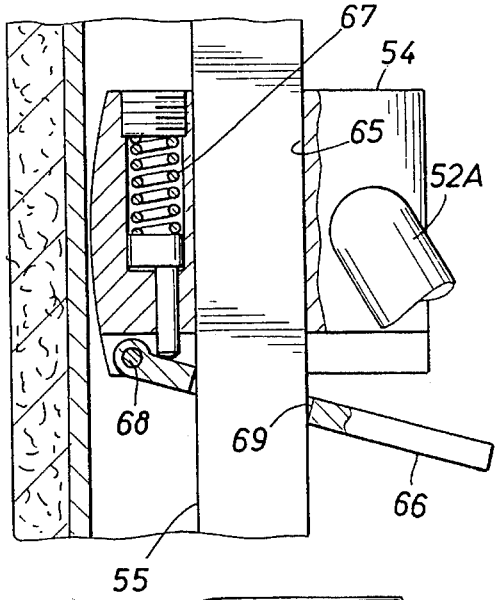
FIG. 12
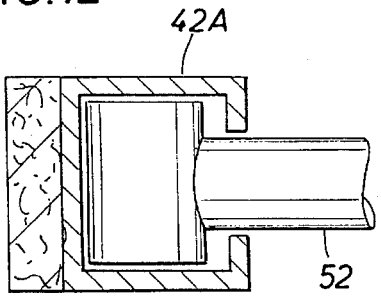
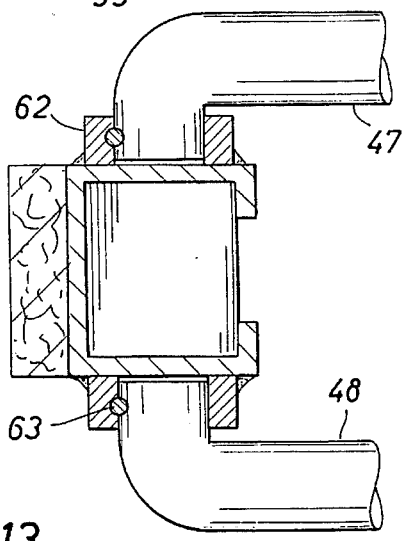
FIG. 13

FIG. 14
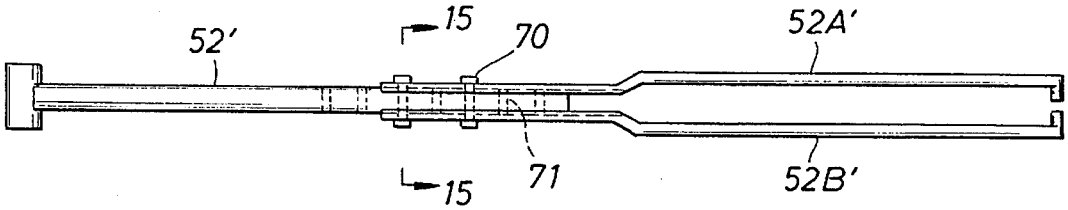
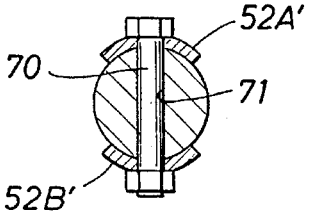
FIG. 15
FIG. 16
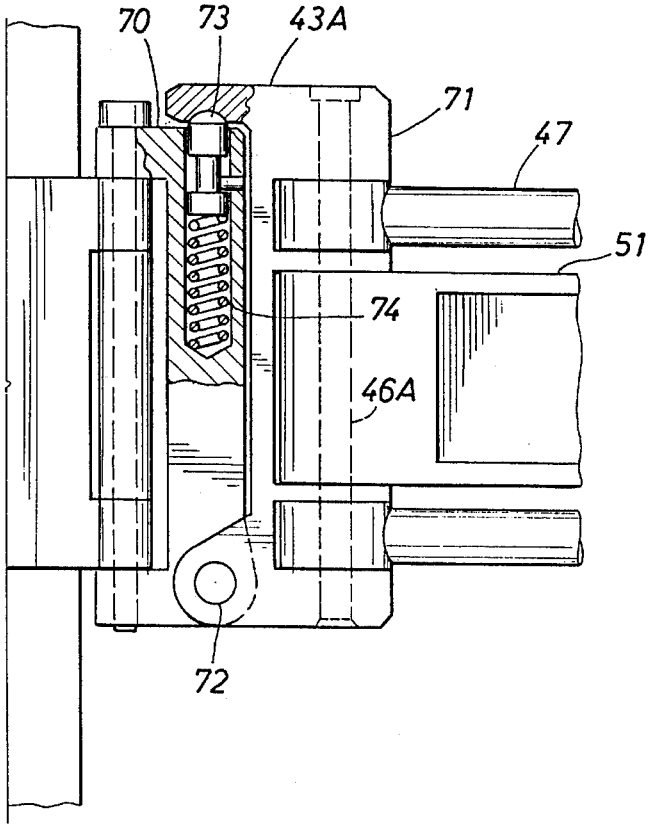
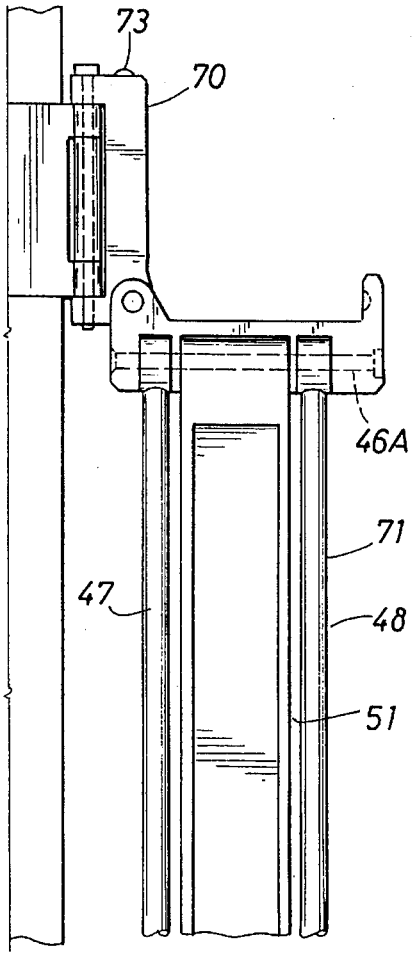
FIG. 17

FIG. 18
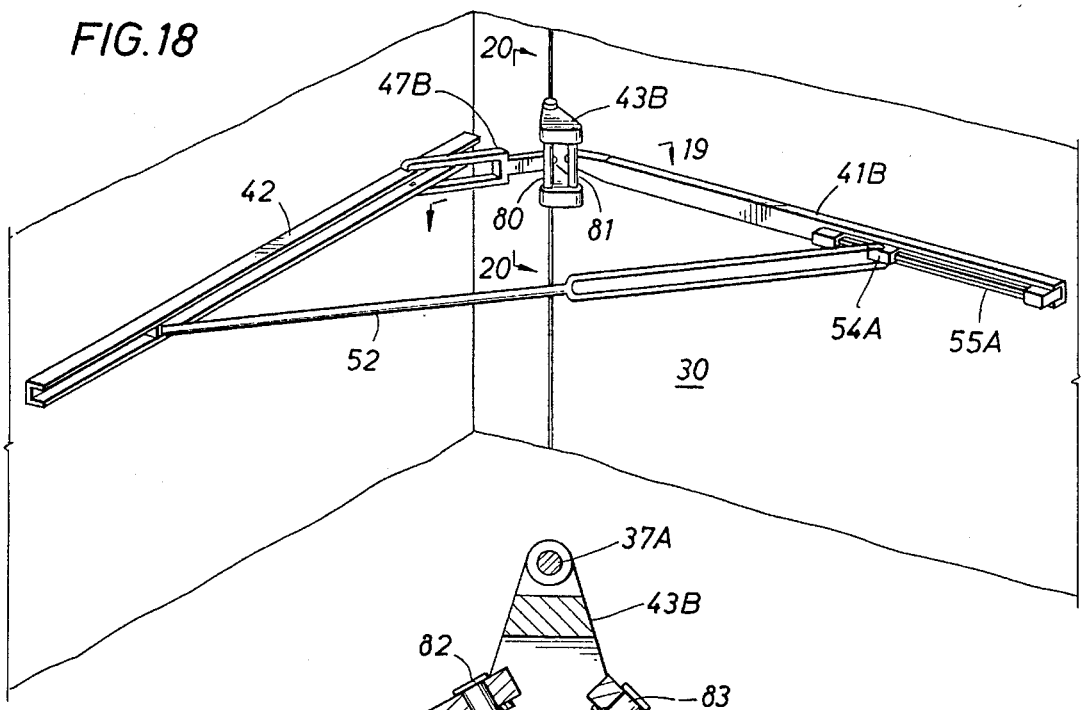
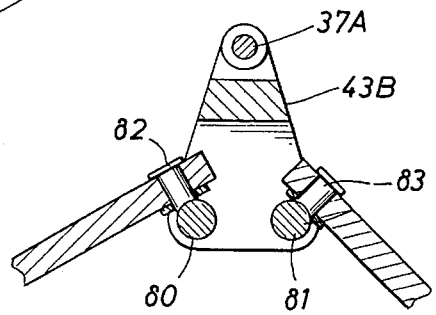
FIG. 19
FIG. 20
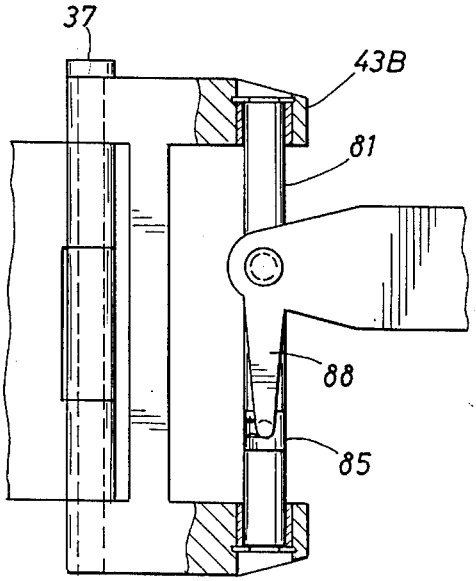
FIG. 21
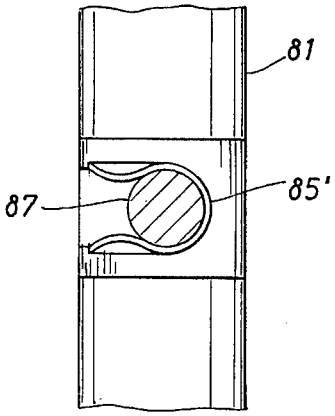

DEVICE FOR LIMITING OPENING MOVEMENT OF A DOOR

This invention relates to a device for limiting opening movement of a hingedly mounted door. More particularly, it relates to an improved device of this type in which the door is held against opening movement by a rigid strut extending diagonally between it and a wall or other surface adjacent to the wall in which the door opening is formed.

One common objection to devices of this type, such as shown in U.S. Pat. Nos. 1,002,812, 1,054,151, 1,693,860, 2,760,806, 4,070,049, 4,346,926, 4,858,972 and 5,039,147, is that they require attachment of one or both ends of the strut to one or more of the door, adjacent wall or floor. This in turn requires that the door or wall or other surface, or both, be defaced by fasteners, as well as some expertise and time in attaching the fasteners in the proper location. Also, many such devices are not adjustable to permit the door to be held either closed or partially open, particularly with ease and speed on the part of the installer or user.

U.S. Pat. No. 3,206,793 shows another type of device for holding a door closed which does not require fastening to the door or the facing of the wall or other surface adjacent the wall in which the door opening is formed. Thus, it comprises a straight bar having a bracket to support it on an existing hinge for the door and an in-turned arm supported by the bracket for engagement at each end with the door and adjacent wall. However, as compared with the other type of devices above described, this device is only capable of holding the door closed. Furthermore, although the device may be stored in a dependent position between the door and wall, this requires that its bar be disconnected from the fitting and then reattached thereto in a depending position.

The object of this invention is to provide a device of this type which does not require attachment to or defacing of the door or wall, which may be held closed or in a partially open position, preferably by means of a quick and simple adjustment, and in which the strut may be easily and quickly moved to a position for stowing in a vertical position adjacent one or both of the door or adjacent wall.

This and other objects are accomplished by a device of the character described, which, in accordance with the illustrated embodiment of the invention, comprises a bracket adapted to be mounted on the door hinge for swinging about the axis thereof, a first arm, a second arm, and means pivotally connecting the first and second arms to the bracket for swinging toward and away from positions against the door and wall, respectively. More particularly, the device further includes a strut extendible between the arms to limit the swinging of the first arm toward the second arm and thus the extent to which the door may be opened when the first and second arms are so positioned against the first and second walls, respectfully.

In the preferred embodiment of the invention, the one end of the strut is pivotally connected to the arm adjacent thereto, and there is a stop on the other arm which faces toward the bracket to engage the other end of the strut when extended between the arms. More particularly, a means is provided for adjusting the position of one of the stop and pivotal connection lengthwise of the arm adjacent thereto, so as to limit the extent to which the door may be opened. As illustrated, the pivotal connection of the other end of the strut to the one arm is preferably mounted for longitudinal movement with respect to the one arm disposable against the door. Thus, as illustrated, the one arm has a longitudinal guide thereon, the pivotal connection comprises a body slidable along the guide and pivotally connected to the other end of the strut, and a means is carried by body for releasably fixing the longitudinal position of the body on the guide.

In the preferred embodiment, the means pivotally connecting the arms to the bracket includes means for swinging the arms about a transverse axis into and out of a depending position, and thus to a location in which it's least apt to constitute a physical or visual problem and linkage. Also, the arm disposable against the wall adjacent the door is connected to the bracket by linkage which enables it to assume a position against the wall along its full length despite its spacing from the door opening.

In the drawings, wherein like reference characters are used throughout to designate like parts:

FIG. 8 is an enlarged cross-sectional view of the second arm and one end of the strut, as seen along broken lines 8—8 of FIG. 1;

FIG. 9 is another enlarged cross-sectional view of the second arm and the end of the linkage pivotally connected thereto, as seen along broken lines 9—9 of FIG. 1.

FIG. 10 is a cross-sectional view of the first arm, as seen along broken lines 10—10 of FIG. 1, and showing the mounting of the body on a guide bar of the first arm;

FIG. 11 is a horizontal sectional view of the body and guide bar, together with a brake for releasably fixing the position of the body with respect to the guide bar, as seen along broken lines 11—11 of FIG. 10;

FIG. 12 is a cross-sectional view similar to FIG. 8, but showing thee end of the strut received in an alternative form of the guide of the second arm;

FIG. 13 is a view similar to FIG. 9, but showing an alternative form of the linkage connecting the second arm to one end of the strut;

FIG. 14 is a side view of an alternative embodiment of the strut;

FIG. 15 is an enlarged cross-sectional view of the embodiment of the strut shown in FIG. 14, as seen along lines 15—15 thereof;

FIGS. 16 and 17 are side views, partly in section, of an alternative form of the bracket for the device which includes an outer portion releasable from an inner portion mounted on the door hinge to permit the arms to be swung downwardly from the position of FIG. 16 to the depending position of FIG. 17;

FIG. 18 is a perspective view of an alternative embodiment of the device, disposed in the position of FIG. 1, but having a modified bracket and connection between the first arm and linkage which permits the arms and strut to be swung downwardly to a depending position, as in the case of FIGS. 16 and 17;

FIG. 19 is an enlarged cross-sectional view of the bracket and its connection to the ends of the first arm and linkage, as seen along broken lines 19—19 of FIG. 18;

FIG. 20 is a detailed view, on enlarged scale, of the bracket and its connection to the linkage, as seen along broken lines 20—20 of FIG. 18; and FIG. 21 is an enlarged sectional view of a clamp for releasably holding the linkage in the horizontal position, as shown in FIG. 20.

Figure 1:
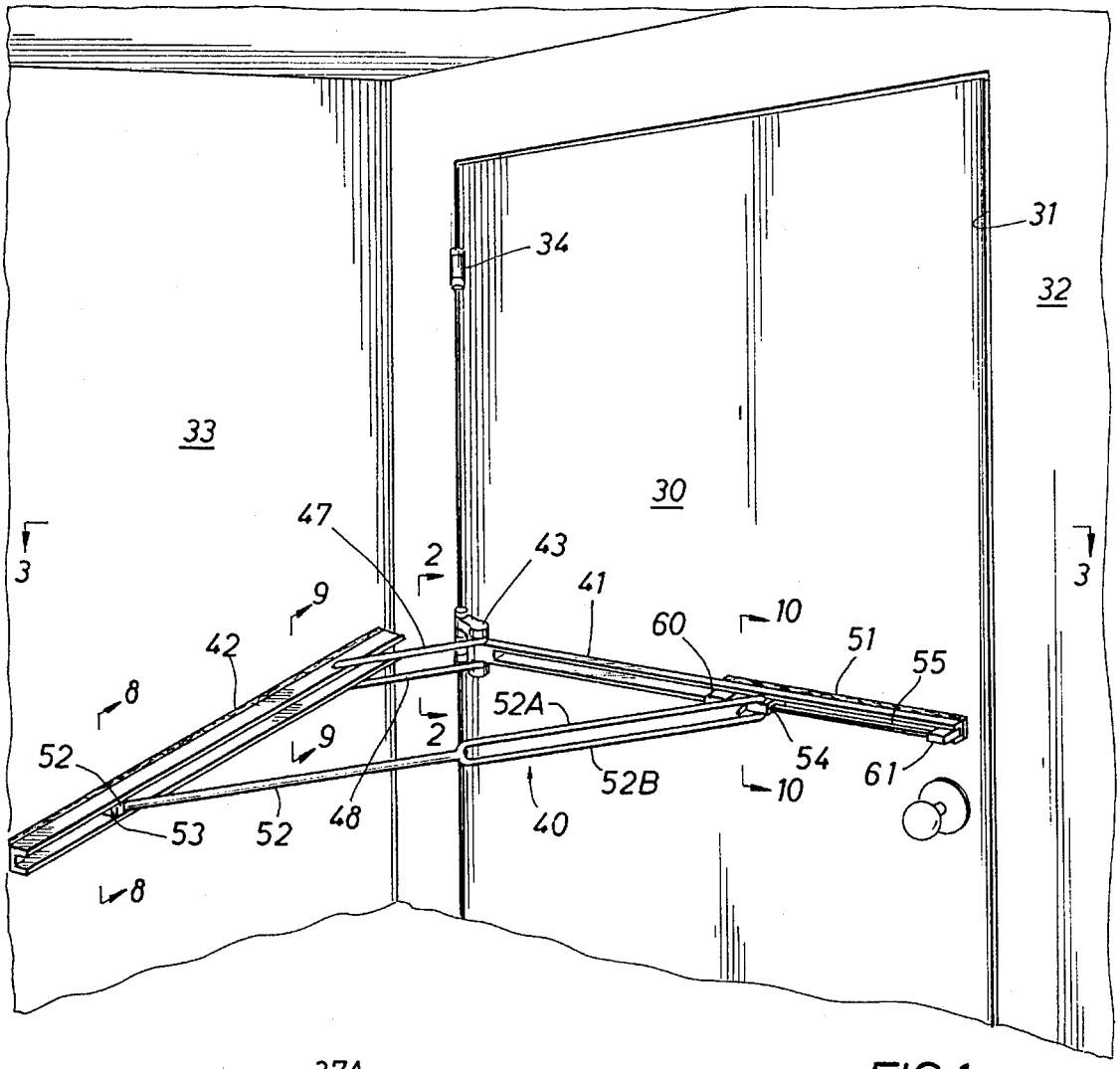
FIG. 1 is a perspective view of a device constructed in accordance with one embodiment of the present invention and showing the strut thereof extending diagonally between the arms which are against the door and adjacent wall.

With reference now to the details of the above-described drawings, the door 30 is adapted to swing between positions opening and closing access opening 31 formed in a wall 32 adjacent another wall 33, and thus typically control access to or from a room formed in part by the walls 32 and 33. The door is pivotally mounted on one edge of the opening 31 by means of a conventional door hinge having plates 34 and 35 fastened to the adjacent ends of the door and opening 31 and pivotally connected to one another by pin 37 received through sleeves 34A and 35A of the plates and having a head 37A resting on the uppermost sleeve. Thus, the hinge is of conventional construction, except that the pin 37 is longer than the sleeves formed at adjacent ends of the brackets so as to permit mounting of the arms of the device thereon.

Figure 2:
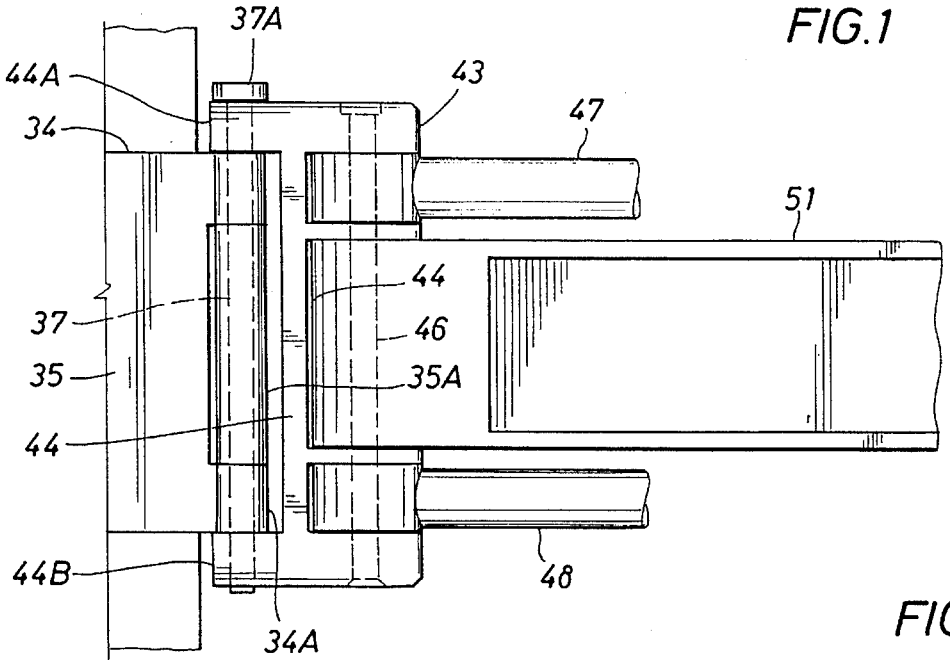
FIG. 2 is an enlarged detailed view, as seen along broken lines 2—2 of FIG. 1, of the bracket of the device mounted on the door hinge and the connection of the ends of the arms thereto.

Thus, the first described embodiment of the device of the present invention, which is indicated in its entirety by reference character 40, includes a first arm 41 to be disposed against the inner side of the door 30 and a second arm 42 adapted to be disposed against the wall 33 when in limiting positions. Each of the arms 41 and 42 is pivotally mounted on a bracket 43 which is in turn mounted on the hinge for pivoting with respect to it about its axis of rotation. Thus, as best shown in FIG. 2, the bracket 43 has upper and lower flanges 44A and 44B above and below a recess 44 on its outer side which extend over the upper and lower ends of the hinge sleeves. More particularly, these flanges are provided with holes to closely receive the elongated hinge pin 37, thus permitting the bracket to be swung about the axis of the hinge pin.

The arm 42 disposable against the wall 33 is pivotally connected to the bracket 43 by means of linkage including upper and lower links 47 and 48 having inner ends received in slots on the outer side of the bracket above and below recess 44 and pivotable about a pin 46 journaled in the outer end of the bracket parallel to the axis of the hinge pin 37. The outer ends of the links are pivotally connected to the upper and lower flanges of a longitudinal guide channel 42A of the arm, as best shown in FIG. 9. As previously described, the purpose of the linkage is to permit the arm to be positioned parallel to the wall 33, despite the spacing between the door opening and thus the pivotal axis of the bracket and the wall 33.

The other arm 41 also includes a longitudinal guide channel 51 which is received in the recess in the outer side of the bracket and pivoted directly to the pin 46, as shown in FIG. 2. Since the axis of pin 46 is close to the door (see FIGS. 3 to 5), the channel of the arm is disposable closely against the inside of the door without need for connecting links.

As previously described, the device further includes a strut 52 which is adapted to extend diagonally between the arms 41 and 42 to hold them in a desired angular relation which limits opening movement of the door. Thus, the strut has one end which is disposable adjacent a stop 53 received within the longitudinal guide of arm 42, so as to limit movement of that one end in a direction away from the bracket, and the other end of the strut is pivotally connected to a body 54 which is guidably moveable along a bar 55 supported on the inner side of longitudinal guide 51. The body is releasably connected to the bar so as to permit the right-hand end of the strut to be fixed relative to the length of the arm 41, depending on the extent to which the door opening is to be limited. Thus, the body carries a brake which is accessible from the inner side of the door so that it may be selectively engaged with and released from the bar to permit the body to be moved longitudinally of the arm to a desired position and then fixed therein, as will be described to follow.

Figure 3:
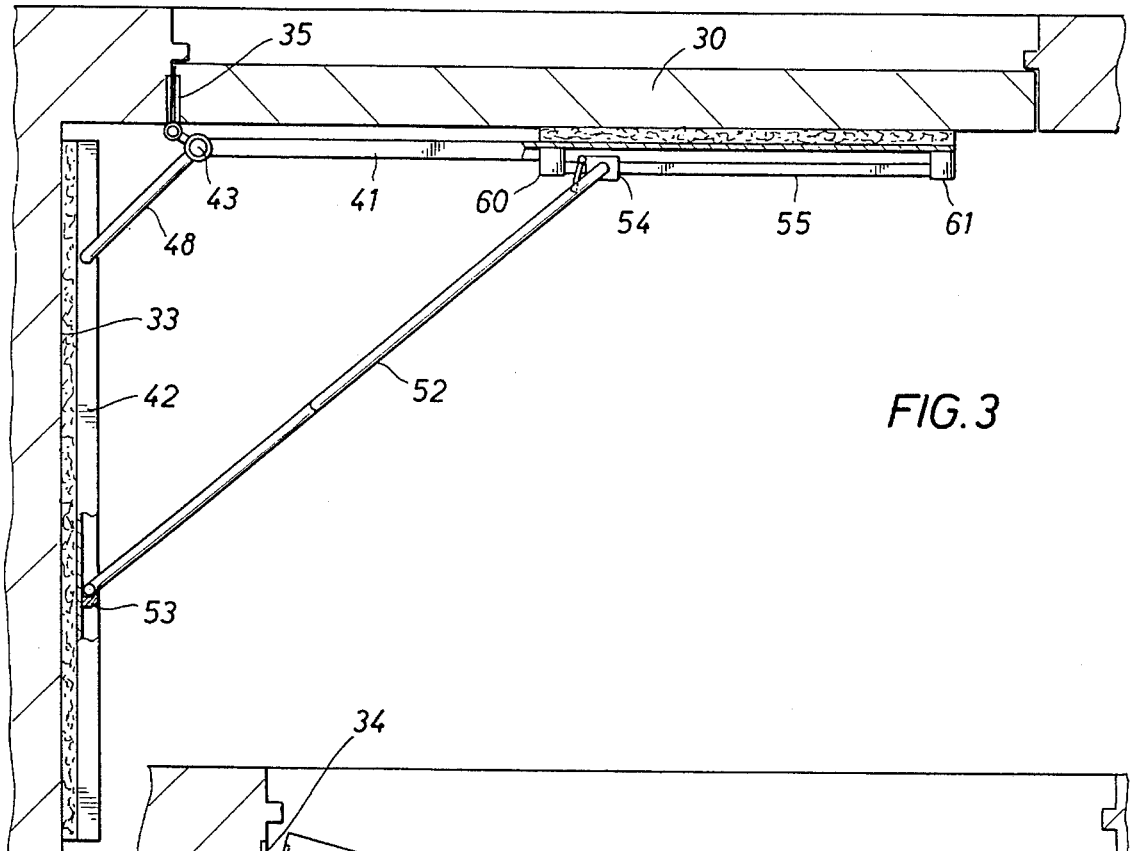
FIG. 3 is a top view of the device, as seen along broken lines 3—3 of FIG. 1, broken away to show the pivotal connection of its one end to a first arm and its other end engaged with a stop on a second arm.
Figure 4:
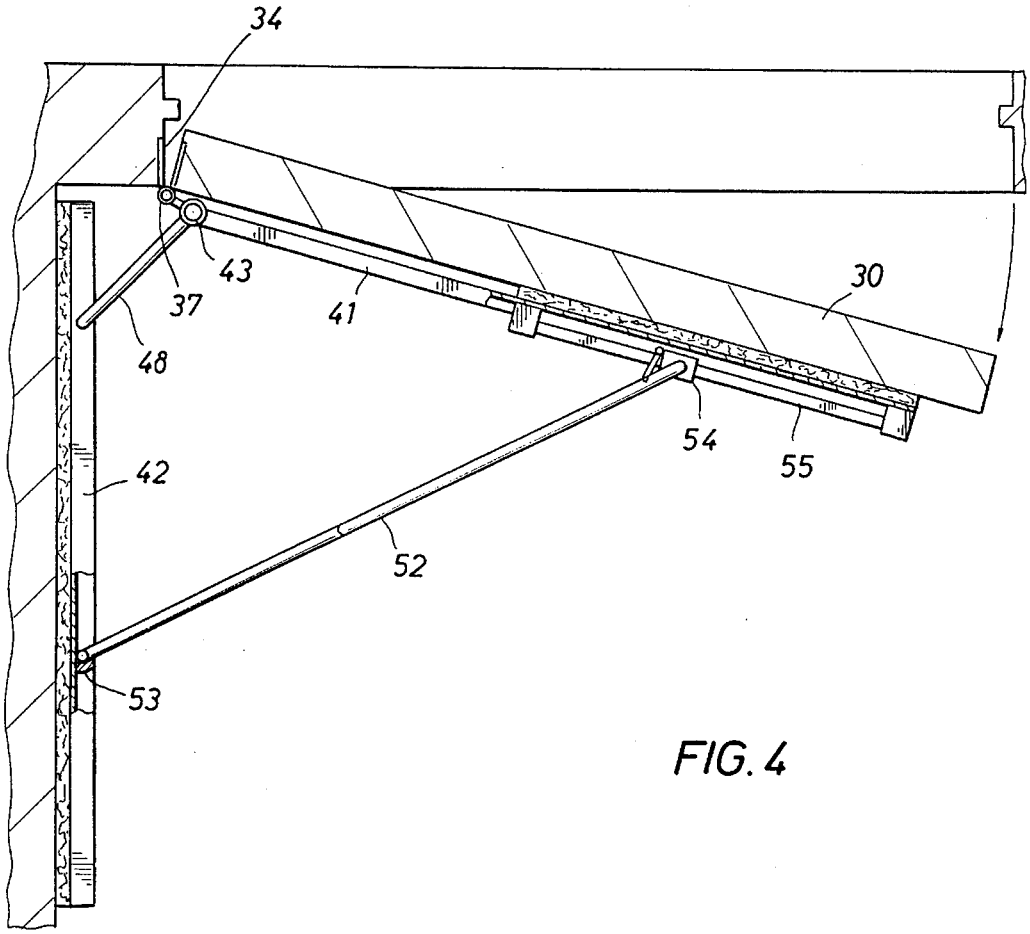
FIG. 4 is a view similar to FIG. 3, but upon movement of the one end of the strut lengthwise of the first arm to permit the door to open.

When the door is to be held in fully closed position, as shown in FIGS. 1 and 3, the body 54 at one end of the strut is moved to a position near the left end of the guide bar of the arm. As previously described, however, the door may be instead locked in a partially opened position by moving the body to an intermediate position along the guide bar, as shown in FIG. 4.

Figure 5:
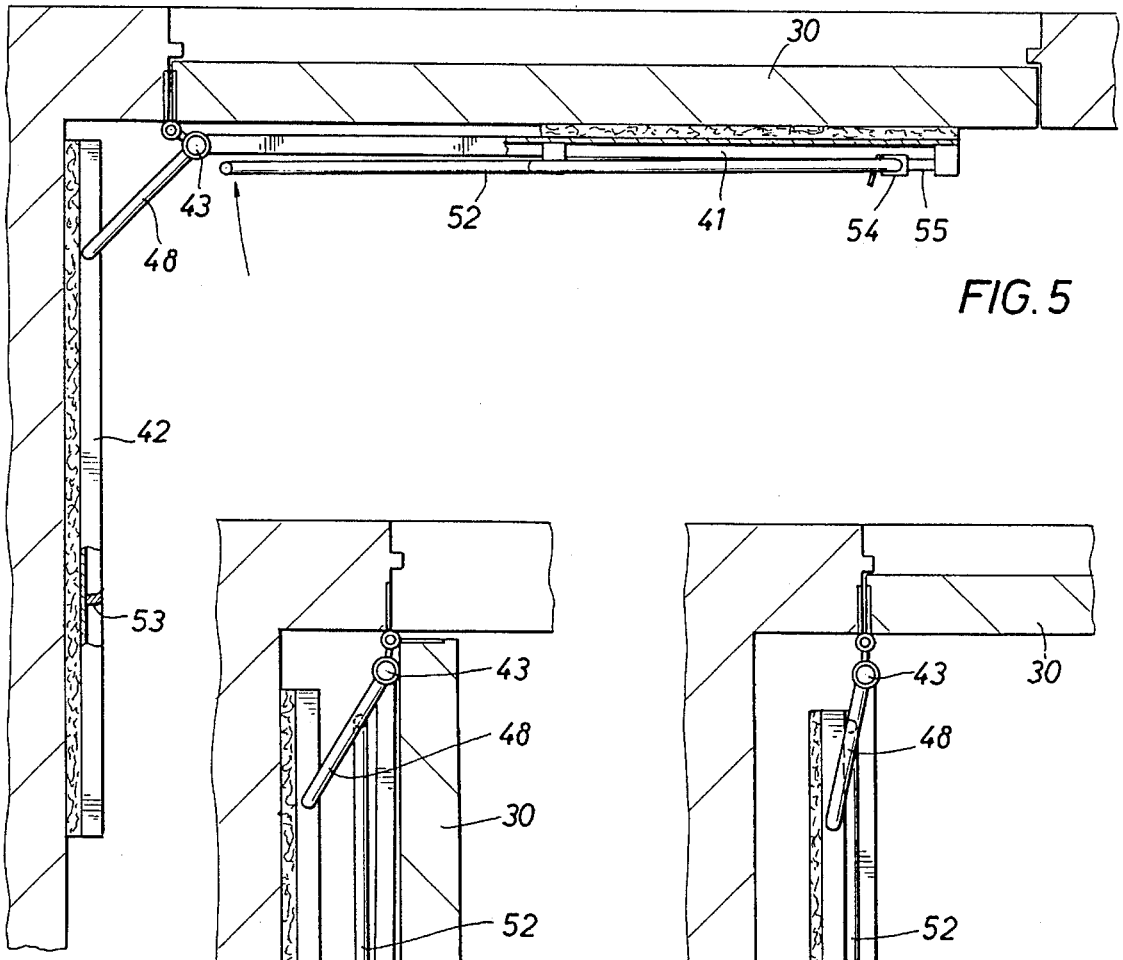
FIG. 5 is another top view of the device, as shown in FIGS. 3 and 4, but with the other end of the strut removed from the stop on the second wall to permit the strut to be folded against the first arm.
Figure 6:
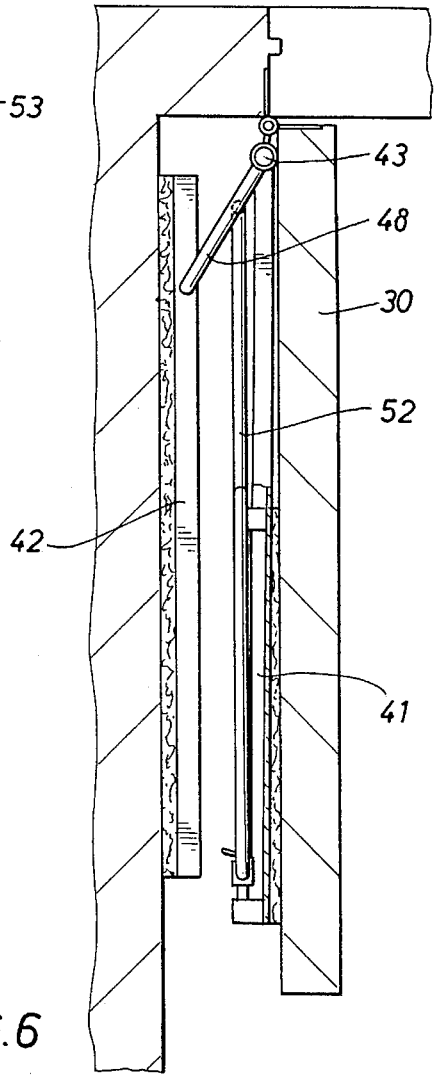
FIG. 6 is another top view of the device, but with the first arm and strut swung with the door toward a position adjacent the second arm and wall.
Figure 7:
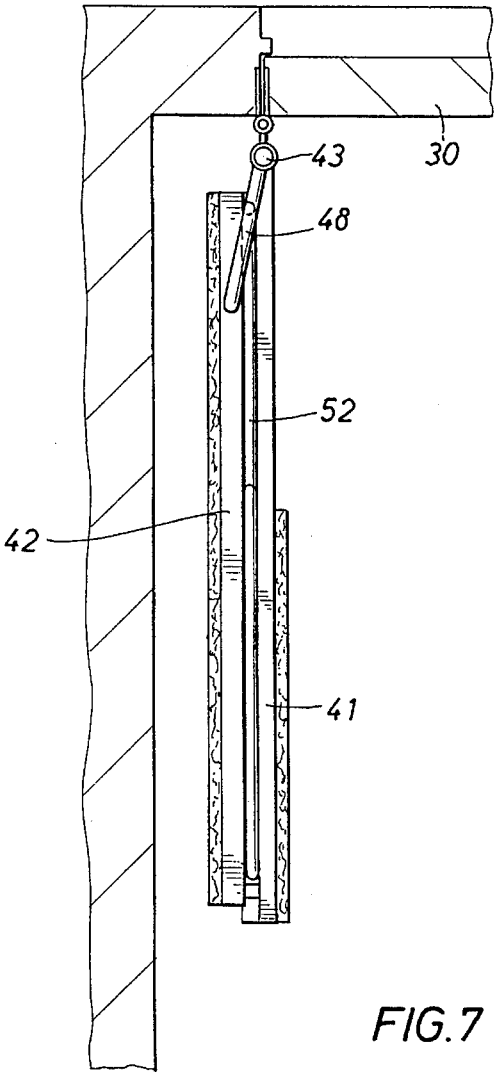
FIG. 7 is a view similar to FIG. 6, but upon swinging of the second arm away from the wall to a position adjacent the strut and first arm.

As shown in FIG. 5, the body may also be moved toward the right hand end of the guide bar as the left end of the strut is moved away from the stop 53 on the second arm, whereby the left end of the strut may then be pulled out of guide channel and folded toward the inner side of the first arm. Thus, as shown in FIG. 6, the door may be fully opened by swinging the folded first arm and the strut toward the inner side of the second arm which is against the wall 33. During this movement, the linkage permits the second arm to swing away from the wall 32, so that, as shown in FIG. 7, it may then be folded toward the strut to hold the strut between the first and second arms.

As best shown in FIG. 8, the left end of the strut has a vertical pin which bears against the stop 53 formed in the longitudinal guide of the second arm. Alternatively, and as shown in FIG. 12, the pin at the left end of the strut may be captured by the flanges of a modified longitudinal guide 42*a* to prevent the left-hand end of the strut from being pulled out of the guide, at least until it moves toward an outlet (not shown) from the channel toward its inner end.

As illustrated in FIG. 9, one end of each link 47 and 48 is turned to extend through holes in the upper and lower flanges of the longitudinal guide channel of the second arm for fitting within a block 60 disposed within the channel, and these ends are releasably connected to the block by means of studs 61. Alternatively, and as shown in FIG. 13, the turned ends of the links may be releasably connected to cylindrical collars 62 secured to the upper and lower outer sides of the lower flanges of the longitudinal guide by pins 63.

As shown in FIGS. 10 and 11, the guide bar 55 on the inner side of the first arm fits closely within a slot 65 through the body 54 to permit the body to slide from one end to the other of the bar. The body is adapted to be releasably held in a desired position along the bar by means of a brake best shown in FIG. 11 as comprising an arm 66 pivotally connected to the body by pin 68. The arm is urged by a spring 67 carried by the body 54 to the position shown in FIG. 11 in which an enlarged slot 69 formed therein is disposed angularly with respect to the bar so as to bind the body in a fixed position longitudinally of the bar. Movement of the arm upwardly from the position of FIG. 11 will of course release the body for movement to another position longitudinally of the bar. The turned ends of the upper and lower strut rods 52A and 52B are pivotally mounted on an outer exterior of the body to permit relative rotation between the strut and body as the door is swung to different positions.

In a modified version of the strut 52' shown in FIG. 14, the inner ends of the upper and lower strut rods 52A' and 52B' are connected to the left end of the rod in adjusted positions by means of pins 70 received through selected holes 71 in the left end. As shown in FIG. 15, the ends of the upper and lower strut rods are curved to fit closely about the round outer contour of the left end of the strut.

FIGS. 16 and 17 show a modified version of the bracket 43A made up of an inner part 70 pivotally mounted to the hinge pin of the door, and an outer part 71 pivotally connected to the inner part 70 by means of a transverse pin 72 at their lower ends on the inner side of a pin 46A connecting the bracket with the arm 41 and the inner ends of the links 47 and 48. The outer part 71 of the bracket is releasably held in a position along the outer side of the inner part 70 by means of a detent 73 comprising a pin having an outer end urged into a similarly shaped depression in an overhanging flange of the outer body 71 by means of a coil spring 74. With the outer part 71 held by the detent in its upright position, the strut is in turn positioned to either releasably hold the door in a desired position or to permit the strut and arms to be folded into the position of FIG. 7.

However, upon release of the detent, as shown in FIG. 17, the first and second arms may be swung downwardly with the outer body 71 to permit them to assume a dependant position in an out of the way location. Obviously, the outer part of the bracket may be provided with stop parts to limit swinging of the arms inwardly toward the wall 33.

The embodiment of the device illustrated in FIGS. 18–21 differs from that described in connection with FIGS. 1–13 only insofar as the construction of the bracket and its connection to the first and second arms are concerned. Thus, a recessed outer end of the bracket 43B, which is opposite its inner end connected to the hinge plates by pin 37A, receives a pair of posts 80 and 81 releasably retained at their upper and lower ends within holes through the upper and lower flanges of the outer end of the bracket. More particularly, these posts are spaced apart, with the post 80 providing a pivotal connection to linkage 47B connected to arm 42 and pivot post 81 providing a pivotal connection to the inner end of the arm 41B disposable against the door, thus enabling both arms to be swung about a vertical axis.

This of course permits the arms to be moved into the positions shown in FIG. 18, and the strut to be extended between them to limit the extent to which the door 30 may be opened. The outer forked end of the linkage 47 is pivotally connected to the upper and lower flanges of the guide member of the second arm 42 in the manner described in connection with the first embodiment of the invention. The inner end of the first arm 41B differs from the arm of the first described embodiment in that the guide channel portion thereof extends for generally only the outer half of the arm. In other respects, the arm and its connection to the right-hand end of the strut 52 is similar to that of the previously described embodiment.

The ends of the linkage and first arm 41B are pivotally connected to pins 82 and 83 extending radially from the posts 80 and 81, respectively, so as to permit each arm to be swung between the generally horizontal positions shown in FIGS. 18, 19 and 20 and the depending positions for the purposes described in connection with FIGS. 6 and 7. As was described in connection with the first embodiment, movement of the arms to this depending position is made possible by movement of a body 54A pivotally connecting the right-hand end of the strut 52 to the arm 41B outwardly along its guide bar 55A, thus releasing the left-hand end of the strut from the stop on the arm 42, whereby continued outward movement of the adjustable body connection of the right-hand end of the strut to the first arm permits it to be swung into a position generally parallel thereto. The inner end of the arm 42 is free to move within left end of the forked linkage to a position generally in alignment therewith, thus permitting the arm to be folded against the strut when it has been folded against the first arm.

Each of the linkage and arm 41B is held in its horizontal position, as shown in FIG. 18, by means of a clasp 85' mounted on the side of a collar 85 intermediate the upper and lower ends of each post to receive a pin 87 on a flange 88 at the inner end of the linkage and arm 41B. Thus, as shown in FIG. 21, the clasp has a flexible inner end which is adapted to releasably receive the pin 87 to hold the flange 88 generally vertically, and thus hold the arm to which it is connected in a generally horizontal position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A device for use in limiting the swinging of a door hingedly connected to a first wall toward a second wall adjacent to the first wall, comprising a bracket adapted to be mounted on the door hinge for swinging about the axis thereof, a first arm, a second arm, means pivotally connecting the first and second arms to the bracket for swinging toward and away from the door and adjacent wall, respectively, and a strut extendible between the arms to limit the swinging of the first arm toward the second wall and thus the extent to which the door may be opened when the first and second arms are against the first and second walls, respectively.

2. A device as in claim 1, including means pivotally connecting one end of the strut to one arm, and means on the other arm providing a stop facing toward the bracket in position to be engaged by the other end of the strut when extended between the arms.

3. A device as in claim 2, including means for adjusting the position of one of the stop and the pivotal connection lengthwise of the arm adjacent thereto.

4. A device as in claim 3, wherein the pivotal connection of the other end of the strut to the one arm is mounted for longitudinal movement with respect to said first arm.

5. A device as in claim 4, wherein the pivotal connection comprises a body guidably slidable along the first arm and pivotally connected to the other end of the strut, and means are providing for releasably fixing the longitudinal position of the body along the guide.

6. A device as in claim 1, wherein the means pivotally connecting the arms to the bracket includes means for swinging the arms about a transverse axis into and out of a depending position.

7. A device as in claim 1, wherein the means pivotally connecting the second arm to the bracket includes linkage pivotally connected between them.

* * * * *